US005248270A

United States Patent [19]

Finkl

[11] Patent Number: 5,248,270

[45] Date of Patent: Sep. 28, 1993

[54] STRUT SUPPORT FOR PROPELLER SHAFT

[76] Inventor: Anthony W. Finkl, 445 E. Royal Flamingo Dr., Sarasota, Fla. 34236

[21] Appl. No.: 918,176

[22] Filed: Jul. 23, 1992

[51] Int. Cl.[5] ..... B63H 5/10

[52] U.S. Cl. ..... 440/82; 248/317

[58] Field of Search ..... 440/79, 82, 83; 248/674, 675, 677, 640, 635, 688, 317, 913

[56] References Cited

U.S. PATENT DOCUMENTS

| | | | |
|---|---|---|---|
| 3,938,464 | 2/1976 | Gill | 440/82 |
| 4,089,289 | 5/1978 | Sauder | 440/82 |
| 5,017,168 | 5/1991 | Ackley | 440/82 |

FOREIGN PATENT DOCUMENTS

| | | | |
|---|---|---|---|
| 325852 | 2/1930 | United Kingdom | 440/82 |

*Primary Examiner*—Robert J. Oberleitner
*Assistant Examiner*—Clifford T. Bartz
*Attorney, Agent, or Firm*—Baker & McKenzie

[57] ABSTRACT

An improved strut support for propeller shafts of marine vessels is provided. The improved strut support includes a palm, a strut section and a propeller shaft bearing. The palm includes horizontal and vertical sections for mounting to the hull and transom, respectively. The strut section connects the propeller shaft bearing to the palm and is connected to the horizontal section, the vertical section and a slot disposed in the rear portion of the horizontal section for improved rigidity and propeller shaft stability.

16 Claims, 2 Drawing Sheets

STRUT SUPPORT FOR PROPELLER SHAFT

This invention relates generally to strut supports for propeller shafts and, specifically to strut supports for propeller shafts on inboard motor boats. More particularly, this invention relates to an improved strut support design that provides increased propeller shaft stability in the transverse, longitudinal and vertical directions.

BACKGROUND OF THE INVENTION

The construction of an inboard motor boat normally requires the propeller shaft to pass through the rear portion of the bottom of the hull. A non-jointed or straight propeller shaft passes through the hull with a packing gland and connects the transmission of the engine to the propeller. In order to reduce the amount of stress on the packing gland and the opening of the hull where the propeller shaft passes through, the propeller shaft must be supported somewhere between the engine transmission or the propeller shaft packing gland (if the packing gland is of the rigid type) and the propeller. The assembly for supporting propeller shafts is commonly referred to as a strut support.

The strut support for propeller shafts taught by the prior art consists of three basic elements: the palm, the strut section and the propeller shaft bearing. The palm is typically a flat mounting plate that is attached to the bottom of the hull. The strut section is another flat plate attached perpendicularly to the center line of the palm and connecting the palm to the propeller shaft bearing housing. The propeller shaft bearing is normally a hollow metal tube, the housing, containing suitable bearing material that supports the propeller shaft.

The above design, while fairly simple in construction and inexpensive, presents many disadvantages. First, the only means for support against shocks and stress in the transverse direction (i.e. perpendicular to the propeller shaft in the horizontal plane) on the strut section is the connection between the strut section and the palm. As noted above, the upper end or edge of the strut section is welded or cast perpendicularly to the palm. Thus, forces in the transverse direction, through leverage, can render significant stress on the strut/palm joint. If the strut is merely welded or cast to the palm, the weld or casting can fail resulting in damage to the propeller shaft, hull bottom and engine.

Conventional strut supports are vulnerable to forces in the longitudinal, transverse, (i.e. from the stern to the bow) and vertical directions as well. In effect, the integrity of the conventional strut support rests on the single connection between the strut section, the palm, and the palm bolted or screwed to the bottom of the boat. Even if the three components (i.e. the palm, the strut section and the propeller shaft bearing) are assembled as a single casting, the palm/strut section can, and does, fail from external forces.

Further, it is often desirable to present the propeller behind the transom to reduce propeller generated noise. When the propeller is located beneath the hull, shock waves cause noise or vibration against the hull. As noted above, conventional strut supports require the palm of the strut support to be mounted to the bottom of the hull forward of the transom. Therefore, in order to present the propeller behind the transom, a significant length of propeller shaft between the strut support and the propeller must be exposed in an unsupported condition thereby leaving the exposed portion of the propeller shaft vulnerable to damage.

Thus, the conventional strut supports are deficient in at least two respects. First, the strut section being attached perpendicularly to the palm leaves the entire strut support assembly vulnerable to forces in the transverse longitudinal and vertical directions relative to the strut section. Second, the conventional strut supports require the palm, and the entire support for that matter, to be mounted to the underside of the hull. If it is desired to present the propeller behind the transom, conventional strut supports leave a substantial length of propeller shaft exposed and unsupported and therefore vulnerable to damage which can result in expensive repairs.

BRIEF DESCRIPTION OF THE INVENTION

The present invention makes a significant contribution to the recreational boat industry by providing a strut support for propeller shafts with improved transverse, longitudinal and vertical rigidity. The strut support of the present invention allows a boat designer to present the propeller behind the transom without leaving a substantial length of propeller shaft exposed and unsupported. Presenting the propeller behind the transom substantially reduces propeller noise. The improved strut support also allows boat designers to employ lower shaft angles for improved horizontal forward thrust and for surface-drive propulsion systems at lower costs. Lower propeller shaft angles also allow the designers to move the engine closer to the stern.

The present invention accomplishes all of the above with a relatively inexpensive design and without expensive modification or design adjustments to the basic designs of inboard motor boats already in the commercial production. The strut support of the present invention is intended to serve as original equipment on new boats and also as a modification and an improvement to existing inboard motor boats.

The improved strut support still consists of essentially three components: (1) a palm, (2) a strut section and (3) a propeller shaft bearing. However, the improved palm of the present invention includes not only a horizontal section for mounting on the bottom of the hull but also a vertical section for mounting to the transom. The improved palm also includes a horizontal section with a longitudinally extending slot disposed in the rear portion of the horizontal section. The vertical section of the improved palm is mounted on top of the horizontal section. The vertical section/horizontal section angle will match the angle where the hull and transom meet.

The strut section connecting the palm to the propeller shaft bearing is attached to the lower surface of the horizontal section, the rear surface of the vertical section and is received in the slot disposed in the rear portion of the horizontal section. Thus, the strut support provides improved rigidity for the propeller shaft because the strut section is connected to and supported at the palm in the transverse, longitudinal and vertical directions.

The propeller shaft bearing is mounted to the lower end of the strut vertical section. While forces applied to the propeller shaft bearing or the lower end of the strut section in the transverse direction still have a leverage effect on the connection between the upper end of the strut section and the palm, the new design for attaching the upper end of the strut section to the palm counteracts the effects of leverage. One portion of the upper end of the strut section is accommodated in the slot in the rear end of the horizontal section. Thus, the rear end of the horizontal section provides extra support for the strut section in either transverse direction. Further, forces applied to the propeller shaft bearing or the lower end of the strut section in the vertical or longitudinal directions are now counteracted by (1) the connection between the upper end of the strut section to the lower surface of the horizontal section, (2) the connection between the rear surface of the vertical section and the upper end of the strut section as well as (3) the connection between the strut section and the slot at the rear end of the horizontal section.

Therefore, it is an object of the present invention to provide a strut support that greatly increases propeller shaft stability by providing a palm with both vertical and horizontal planes instead of a single horizontal plane along with a rear slot in the horizontal plane for accommodating the upper end of the strut section. The entire strut can be cast as a single piece instead of a multiple piece weldment if so desired.

It is another object of the present invention to reduce propeller noise by providing a strut support that enables a boat designer to easily present the propeller behind the transom thereby reducing the amount of shock waves and vibrations against the hull which are caused by propellers operating below the hull.

Still another object of the present invention to provide a strut support that enables a boat designer to provide a low propeller shaft angle by limiting the length of the strut section thereby presenting the upper peripheral path of the propeller blades above the bottom of the hull for surface-drive propulsion. Surface-drive propulsion, and low propeller shaft angles in general, provide more efficient propeller thrust resulting in additional boat speed without increasing power for planing type hulls.

Yet another object of the present invention is to provide a strut support for propeller shafts at low angles that more effectively propel the boat forward due to the reduction in the vectored forces raising the stern caused by high shaft angles.

It is yet another object of the present invention to provide a strut support that enables a boat designer to move the engine closer to the transom which increases boat speed for most boats with planing-type hulls.

BRIEF DESCRIPTION OF THE DRAWINGS

This invention is illustrated more or less diagrammatically in the accompanying drawings, wherein.

DETAILED DESCRIPTION OF THE INVENTION

Figure 1:
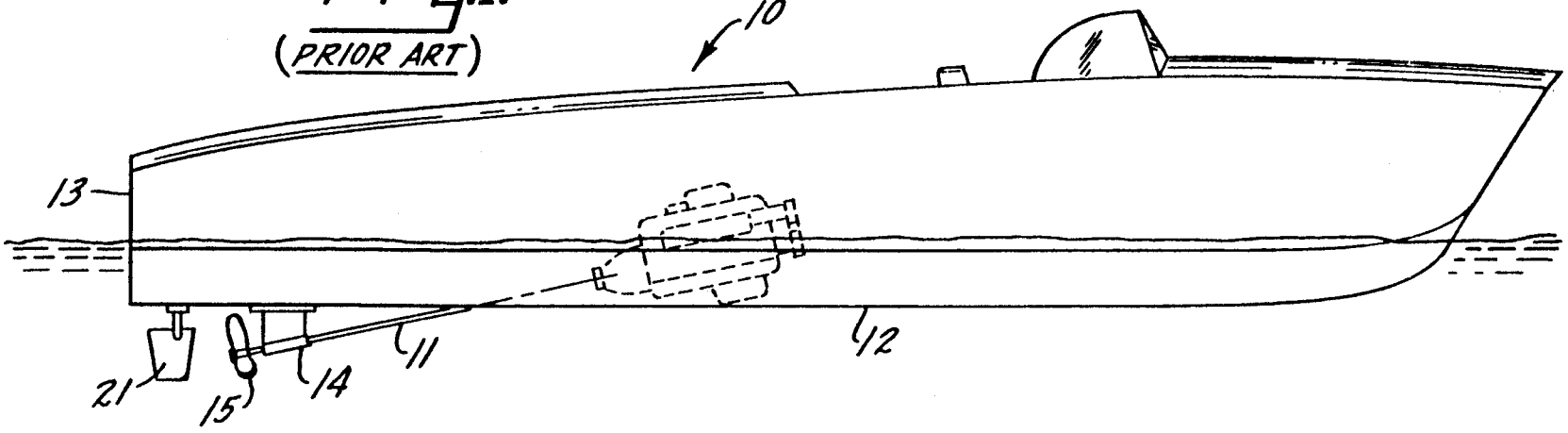
Fig. 1. (PRIOR ART)
FIG. 1 is a starboard side view of an inboard motor boat equipped with a strut support made in accordance with the prior art.

Like reference numerals will be used to refer to like or similar parts from Figure to Figure in the following description of the drawings.

Figure 2:
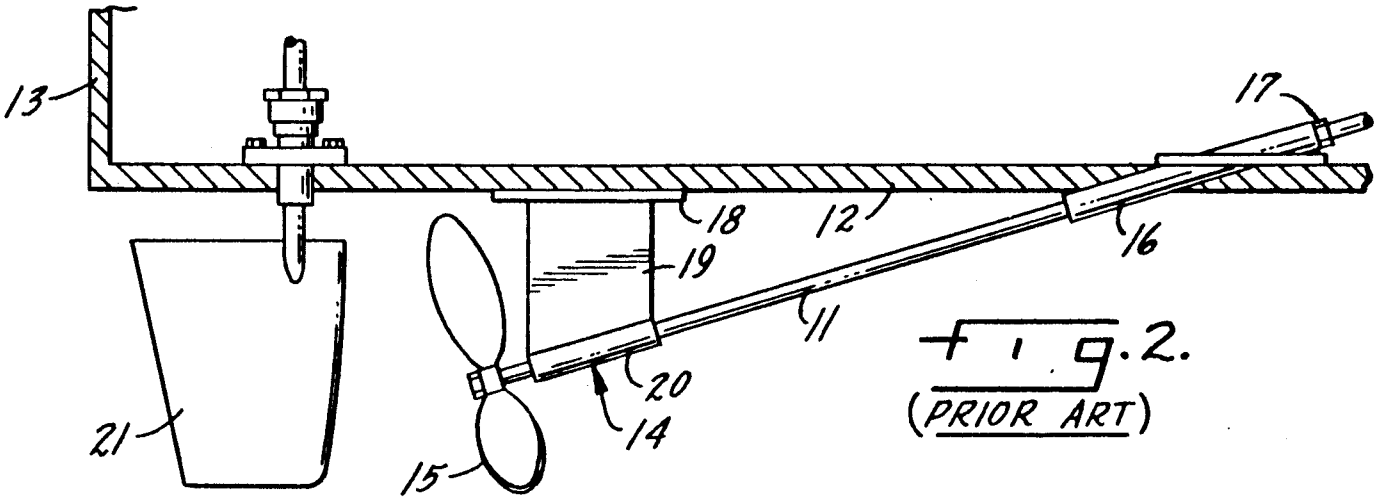
Fig. 2. (PRIOR ART)
FIG. 2 is an expanded view of the strut support made in accordance with the prior art.

The dramatic improvement contributed by this invention is best understood after consideration of strut supports made in accordance with the prior art. As seen in FIGS. 1 and 2, the design of a conventional inboard motor boat 10 requires the propeller shaft 11 to pass through the bottom of the hull 12 in front of the aft portion 13. A strut support 14 provides support for the propeller shaft 11 between the propeller 15 and the shaft log 16 and packing gland 17. The boat 10, as shown, is also equipped with a conventional rudder 21 located aft of the propeller 15.

Turning to FIG. 2, the conventional strut support 14 consists of three components: the palm 18, the strut section 19 and the propeller shaft bearing 20. The palm 18 is a flat horizontal plate mounted to the hull 12. The strut section 19 is yet another flat vertical plate mounted in a perpendicular fashion to the palm 18 and further mounted along the axial center of the propeller shaft bearing 20. As will be shown below, the strut support 14 provides very little rigidity as it is in a single plane, in the directions transverse to connection between the palm 18 and the strut section 19.

Figures 3, 4, 5:
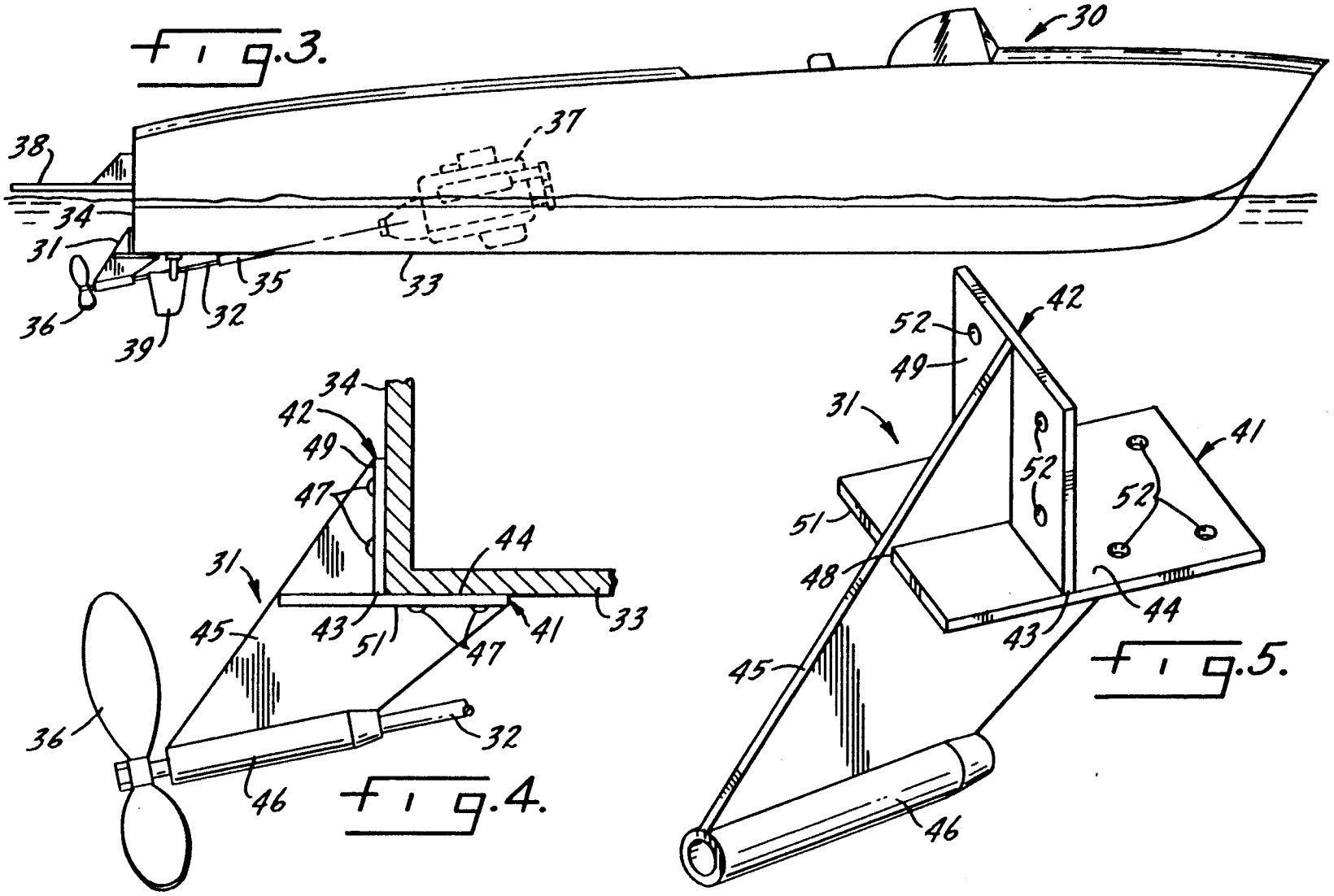
FIG. 3 is a starboard side view of an inboard motor boat equipped with the improved strut support made in accordance with the present invention.
FIG. 4 is a starboard side view of the strut support shown in FIG. 3.
FIG. 5 is a perspective view of the strut support shown in FIG. 3 without the propeller shaft and propeller as a weldment. This strut can also be made as a single piece casting.

The improved strut support 31 provided by the present invention is illustrated in FIGS. 3 through 5. Turning to FIG. 3, an inboard motor boat 30 is shown equipped with the improved strut support 31 that locks the strut assembly in two planes. The propeller shaft 32 passes through the hull 33 near the transom 34. The strut support 31 supports the propeller shaft 32 between the shaft log 35 and the propeller 36.

In the design of the boat 30, the propeller 36 is presented behind the transom 34. In contrast to the strut support 14 taught by the prior art (see FIG. 1), the strut support 31 as disclosed by the present invention provides important support in two planes and protection for the propeller shaft 32 as it extends behind the transom 34. The positioning of the strut support 31 at the transom 34/hull 33 junction enables a designer to present the propeller 36 behind the transom 34 and the hull 33 thereby reducing shock waves and vibrations against the hull 33.

The placement of the strut support 31 at the transom 34/hull 33 junction also enables the designer to place the engine 37 closer to the transom 34 than in conventional systems. Moving the engine 37 closer to the transom 34 effectively shifts the longitudinal center of gravity closer to the transom 34. This action decreases the weight on the front of the hull 33 thereby decreasing drag and increasing the boat speed in most planing-type hulls.

The boat 30 shown in FIG. 3 also employs a swim platform 38. The swim platform 38 blocks excessive upward sprays of water, commonly known as rooster tails, that can result when the propeller 36 is disposed behind the transom 34 and where the tip of the propeller blades may be above the running water line. The swim platform 38 also helps a swimmer avoid contact with the propeller 36. The boat 30, as shown, is also equipped with a conventional rudder 39.

Turning to FIG. 4, the strut support 31 is shown in greater detail. In contrast to the horizontal palm 18 shown in FIG. 2 and taught by the prior art, the palm of the strut support 31 is comprised of two separate components: the horizontal section 41 and the vertical section 42. The lower end 43 of the vertical section 42 is connected to the upper surface 44 of the horizontal section 41. The angle between the vertical section 42 and the horizontal section 41 matches the angle between the transom 34 and the hull bottom 33 to ensure a proper fit. The vertical section 42 and the horizontal section 41 are attached to the transom 34 and hull bottom 33, respectively, by conventional means such as bolts 47, screws or the like.

The improved stability and rigidity of the strut support 31 is evident from the number of connections between the strut section 45 and the vertical section 42 and the horizontal section 41. As seen in FIG. 4, the strut section 45 is mounted in perpendicular fashion to both the vertical section 42 and the horizontal section 41. Further, the strut section 45 is also accommodated in a slot (not shown) disposed in the horizontal section 41 aft of the vertical section 42. Thus, the strut section 45 is also connected to both facing walls of the slot (not shown) in the horizontal section 41 in addition to the perpendicular connections with the vertical section 4 and the horizontal section 41. The strut section 45 is also connected along the axial center of the propeller shaft bearing 46.

FIG. 5 better illustrates the connection between the strut section 45, the vertical section 42 and the horizontal section 41. As noted above, the lower end 43 of the vertical section 42 is connected to the upper surface 44 of the horizontal section 41. A slot 48 disposed in the rear end of the horizontal section 41 aft of the vertical section 42 accommodates the upper end of the strut section 45. Thus, the strut section 45 is connected to and supported by both sides of the slot 48, the rear surface 49 of the vertical section 42 and the lower surface 51 (see FIG. 4) of the horizontal section 41. The holes 52 accommodates the bolts, screws or attachment means 47. This multiple connection/multiple support design provides a strut section 45 with superior rigidity and a strut support 31 that is able to withstand large forces in the transverse, vertical and longitudinal directions.

The propeller shaft bearing 46 is essentially a hollow metal tube enclosing an appropriate bearing material.

Thus, the present invention provides a strut support 31 of superior rigidity by providing a two-dimensional palm that can act in two planes comprising the horizontal section 41 and the vertical section 42 mounted at the transom 34/hull 33 junction. The strut section 45 is supported in the transverse, longitudinal and vertical directions. The strut support 31 can be employed with surface-drive propulsion systems where the outer periphery of the propeller 36 is presented above the bottom of the hull, or running water line, as well as in propulsion systems providing a completely submerged propeller 36. The length of the strut section 45 and therefore the angle of attachment of the propeller shaft bearing 46 to the strut section 45 may be altered. The strut support 31 is useful for both normal and shallow angled propeller shaft systems. The flexibility provided by the design of the strut support 31 enables the boat designer to vary the propeller shaft angle, the engine placement and the propeller presentation.

Although a single preferred embodiment of the present invention has been illustrated and described, it will at once be apparent to those skilled in the art that variations may be made with the spirit and scope of the invention. Accordingly, it is intended that the scope of the invention be limited solely by the scope of the hereafter appended claims and not by the specific wording in the foregoing description.

I claim:

1. A strut support for supporting the propeller shaft of a marine vessel, the strut assembly comprising:

a palm, a strut section, and a housing for a propeller shaft bearing;

the palm including a horizontal section and a vertical section, the horizontal section including an upper surface, a lower surface, a forward end and a rear end, the rear end of the horizontal section including a slot, the vertical section including a front surface, a rear surface, an upper end and a lower end, the lower end of the vertical section being fixedly attached to the upper surface of the horizontal section between the forward end and the rear end of the horizontal section and at a predetermined angle, the front surface of the vertical section including means for attaching the front surface to a transom of the marine vessel, the upper surface of the horizontal section forward of the vertical section including means for attaching the upper surface to the hull of the marine vessel;

the strut section connecting the housing for the propeller shaft bearing to the palm, the strut section including an upper end and a lower end, the lower end of the strut section being fixedly attached to the housing for the propeller shaft bearing, the upper end of the strut section being fixedly attached to the palm at the rear surface of the vertical section, at the lower surface of the horizontal section and at the rear end of the horizontal section at the slot, the strut section both mateably engaging the slot and being fixedly attached to the slot

2. The strut support of claim 1, wherein the housing for the propeller shaft bearing includes a cylinder, the cylinder being fixedly attached to the lower end of the strut section, the cylinder containing bearing means whereby the cylinder supports a rotating propeller shaft at a shaft angle.

3. The strut support of claim 2, wherein the lower end of the strut section is attached to the cylinder of the housing for the propeller shaft bearing along a line parallel to the axial center of the cylinder in reference to the shaft angle.

4. The strut support of claim 1, wherein the horizontal section, the vertical section and the strut section are metal plates.

5. The strut support of claim 1, wherein the horizontal section, the vertical section and the strut section being fixedly attached to one another by welding means.

6. The strut support of claim 1, wherein the horizontal section, the vertical section and the strut section being fixedly attached to one another as a single, one piece casting.

7. The strut support of claim 1, wherein the means for attaching the upper surface of the horizontal section forward of the vertical section to a hull is a plurality of bolts.

8. The strut support of claim 1, wherein the means for attaching the front surface of the vertical section to transom is a plurality of bolts.

9. The strut support of claim 1, wherein the upper end of the strut section includes two edges, a first edge of the upper end of the strut section being fixedly attached to the rear surface of the vertical section, a second edge of the upper end of the strut section being fixedly attached to the lower surface of the horizontal section.

10. The strut support of claim 1, wherein the predetermined angle is 90°.

11. The strut support of claim 1, wherein the predetermined angle is an angle at which the transom meets the hull of the marine vessel.

12. The strut support of claim 1, wherein the horizontal section is V-shaped for attachment to a V-shaped hull centerline.

13. An improved strut support for supporting a propeller shaft of marine vessels, the strut comprising:

vessel attachment means including horizontal plate means and vertical plate means, strut means, propeller shaft support means, the horizontal plate means for attaching the strut to a hull of a vessel, the vertical plate means for attaching the strut to the transom of the vessel, the vertical plate means being fixedly attached to an upper surface of the horizontal plate means, the horizontal plate means including a slot means disposed rearward of the vertical plate means, the strut means connecting the vessel attachment means and the propeller shaft support means, the strut means being mateably engaged in the slot means, the strut means being fixedly attached to the vertical plate means, the horizontal plate means and the slot means, the propeller support means being fixedly attached to the strut means, the propeller support means including bearing means for supporting a rotating propeller shaft.

14. An improved strut support for supporting a propeller shaft of a marine vessel, the strut support comprising:

palm means, strut means, propeller shaft support means, the palm means mounting to a hull-transom junction of the vessel, portions of the palm means attached to both the hull and the transom, the portion of the palm means attached to the hull including a rear extension that extends rearwardly beyond the hull-transom junction, the strut means connecting the portions of the palm means attached to both the hull and the transom as well as to the rear extension of the palm means to the propeller shaft support means, the strut means being supported by the palm means in directions transverse, longitudinal and vertical to the stern-to-bow direction, the propeller support means including bearing means for supporting a propeller shaft.

15. An improved strut support for supporting a propeller shaft of a marine vessel, the strut support comprising:

palm means, strut means, propeller shaft support means, the palm means mounting to a hull-transom junction of the vessel, a substantially horizontal portion of the palm means attaching to the hull, a substantially vertical portion of the palm means attaching to the transom, the substantially horizontal portion of the palm means including a rear extension thereof, the rear extension extending rearwardly beyond the hull-transom junction, the rear extension including a slot for accommodating at least a portion of the strut means, the strut means connecting the palm means to the propeller shaft support means, the propeller support means including bearing means for supporting a propeller shaft.

16. An improved strut support for supporting a propeller shaft of a marine vessel, the strut support comprising:

a palm, a strut, a propeller shaft support, the palm mounting to a hull-transom junction of the vessel, a substantially horizontal portion of the palm attaching to the hull and a substantially vertical portion of the palm attaching to the transom, the substantially horizontal portion including a rear extension that extends rearward beyond the transom, the rear extension including a slot for accommodating at least a portion of the strut, the strut connecting the palm to the propeller shaft support, the strut being supported by the palm in directions transverse to the stern-to-bow direction, the propeller shaft support including means for supporting a propeller shaft and a propeller, the propeller being disposed rearwardly of the strut and palm.

* * * * *